United States Patent [19]

Pevnick

[11] 4,294,406

[45] Oct. 13, 1981

[54] PROGRAM CONTROLLABLE FREE FALLING WATER DROP FOUNTAIN

[76] Inventor: Stephen H. Pevnick, 2314 E. Wyoming, Milwaukee, Wis. 53202

[21] Appl. No.: 960,621

[22] Filed: Nov. 14, 1978

[51] Int. Cl.[3] ..... B05B 17/08; F21P 7/00

[52] U.S. Cl. ..... 239/20; 222/422; 239/211; 239/562; 251/125; D23/13

[58] Field of Search ..... D23/13; 40/406, 407, 40/411, 412; 222/420, 422; 251/125, 129, 145; 137/624.11; 239/16-18, 20-23, 69, 211, 551, 562, 569, 585

[56] References Cited

U.S. PATENT DOCUMENTS

| | | | |
|---|---|---|---|
| 2,328,805 | 9/1943 | Holthouse | 251/129 X |
| 3,286,927 | 11/1966 | Zysk | 239/23 |
| 3,341,087 | 9/1967 | Rosin et al. | 222/422 |
| 3,560,641 | 2/1971 | Taylor et al. | 40/406 X |

*Primary Examiner*—Andres Kashnikow

*Attorney, Agent, or Firm*—Ronald E. Barry

[57] ABSTRACT

A computer controllable water droplet fountain having a plurality of water droplet forming valve assemblies mounted in a constant level water manifold and a base positioned in a vertically spaced relation to said manifold to provide a three dimensional viewing space, a strobe light positioned to illuminate the space, the valve assemblies and strobe light being program controlled to produce various forms of images.

13 Claims, 6 Drawing Figures

PROGRAM CONTROLLABLE FREE FALLING WATER DROP FOUNTAIN

SUMMARY OF THE INVENTION

The water droplet fountain for producing a free falling program of water droplets according to the invention can be controlled by a computer program to produce various forms of three dimensional images. This image can be illuminated by computer controlled light so that the image does not seem to rise or fall in the fountain space but rather demonstrates movement or animation. Computer program release of water droplets allows the fountain to demonstrate a three dimensional image in space. It thus is a three dimensional digital to analogue information display. A rolling image is produced by computer controlled strobe source, by conventional artificial lighting, or by day light. With application of strobe lighting the image can be made to fall or rise at different rates of speed. The image can be made to appear to become stationary via a repeated falling pattern in three dimensional space. And the image can be animated in this mode of lighting to produce a display which changes position each time it passes through the field of the lit strobe field.

The programmed sequential release of water droplets is accomplished by the use of a computer and a digital interface. The interface individually times the interval during which each valve is open determining the size of a water droplet to be released.

DETAILED DESCRIPTION OF THE INVENTION

Figure 1:
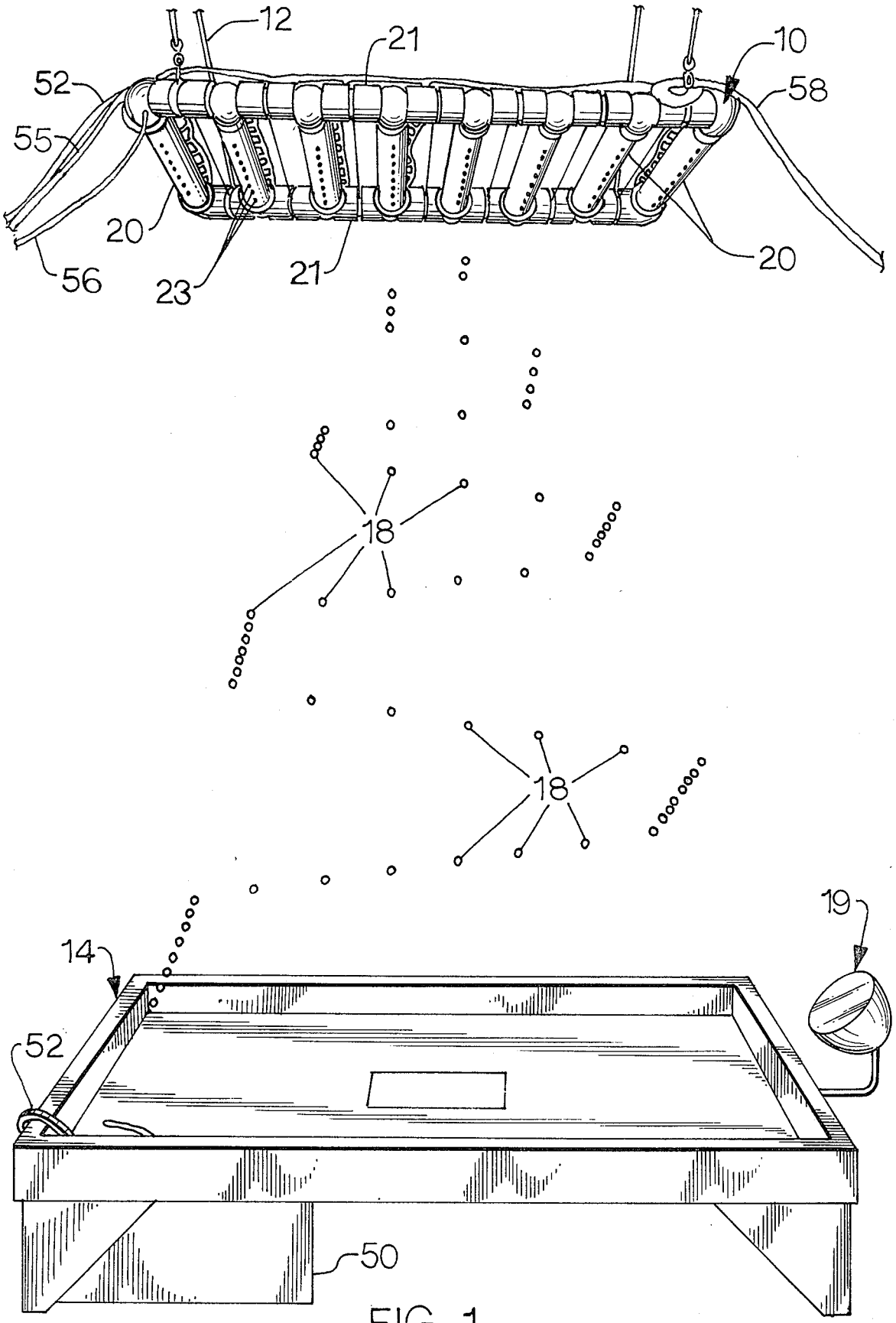
FIG. 1 is a perspective view of the water droplet fountain according to the invention.

The water droplet fountain according to the present invention includes a gravity feed common manifold 10 suspended by any appropriate computer means such as cables 12 in a vertically spaced relation to a base 14. A water droplet image is formed by controlling a plurality of water droplet control valve assemblies 16 provided in the manifold 10 in a controlled sequence to drop water droplets 18 into the base 14. Any appropriate computed means can be used for controlling the valve assemblies 16 to produce a rolling image or an animated framed image both composed of the free falling water droplets.

In this regard, means are provided for illuminating the water droplets 18 to produce the various images. Such means can be in the form of a strobe light 19 to produce the animated framed image. The strobe light is controlled by the computer means in a timed sequence to produce an illusion of movement or animation in the space beneath the manifold. In this mode of operation a stationary (consecutive cluster of droplets) or a stationary animated image (changing cluster of droplets) defined by water droplets can be rendered seemingly still by a coordinated strobing light source. A frame line as in T.V. or Cinema can be provided between consecutive patterns and held constant. Also a rolling image can be produced by means of a controlled strobe light or by conventional artificial lighting or by daylight. By the proper application of the lighting, the image can be made to fall or rise at different rates of speed. In either case, a three dimensional image appears to the viewer.

Figure 6:
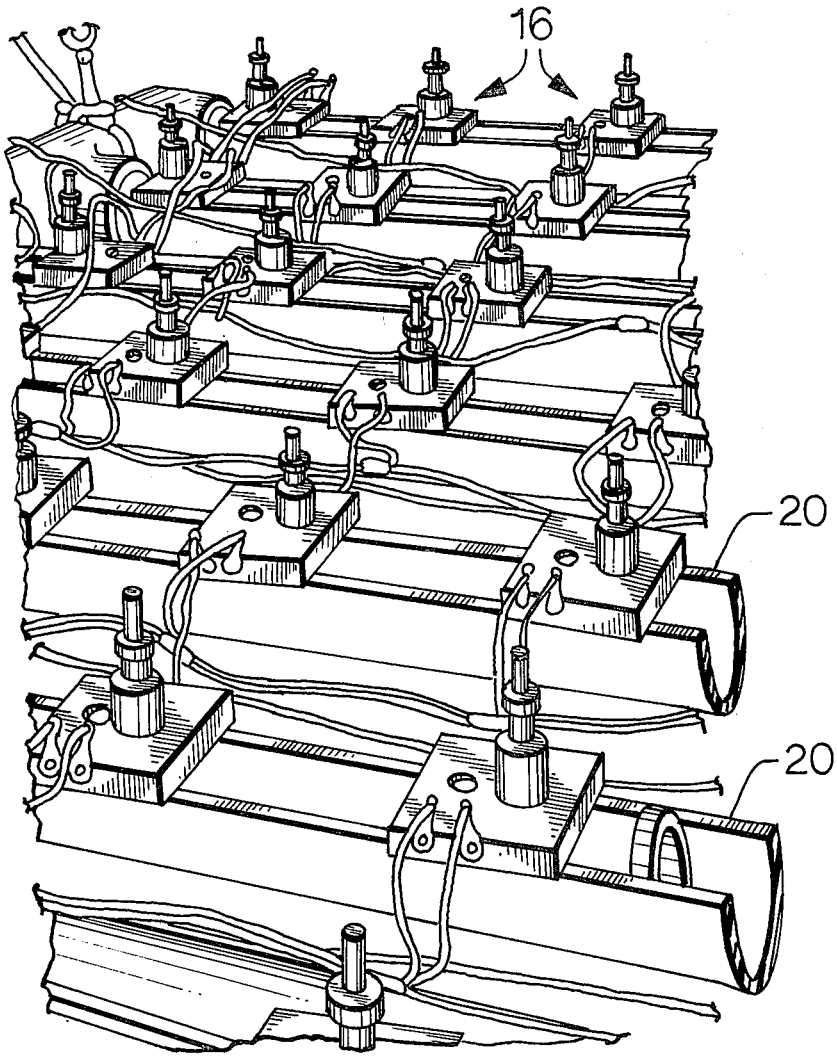
FIG. 6 is a perspective view of a portion of the top of the water droplet manifold.

As seen in FIGS. 1 and 6, the manifold 10 includes a plurality of equally spaced pipes 20 interconnected by headers 21. The pipes 20 are open at the top to accommodate the control valve assemblies 16. A plurality of holes 23 are provided along the bottom of each pipe 20. The size of the water droplets are controlled by means of the valve assemblies 16 provided on top of the manifold pipes 20. The valve assemblies 16 are capable of providing both a controlled rate of discharge of the water droplets 18 as well as a controlled size of water droplets 18. This is critical in providing images of precise configuration to the viewer.

Figure 2:
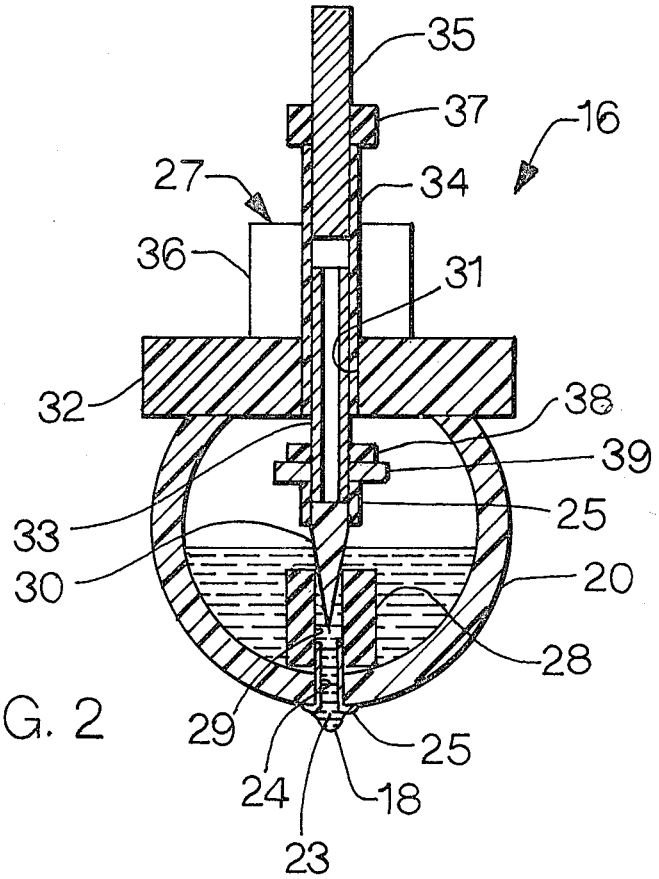
FIG. 2 is a cross section view of one of the water droplet control valve assemblies.

More particularly and referring to FIG. 2, one of the valve assemblies 16 is shown mounted on one of the open top pipes 20 of the manifold 10. Each valve assembly 16 includes means for forming droplets 18 and means for releasing the droplets from the forming means. The means for forming the droplets 18 is in the form of a discharge tube 24 having an annular flange 25 provided in the opening 23. The means for releasing the droplet is provided within the manifold pipe 20 and includes a tubular member 28 which is axially aligned with the discharge tube 24 and a needle-like pintle 30. The pintle 30 cooperates with the central opening 29 of the member 28 to control the release of the water droplets.

Figure 3:
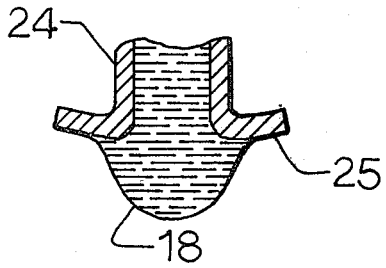
FIG. 3 is an enlarged view of a portion of the water droplet control valve assembly showing the surface tension droplet formation on the droplet release portion of the discharge tube.

Referring to FIG. 3, the water droplet 18 is formed by the surface tension of the droplet with respect to the flange 25 on the end of the tube 24. The flange 25 can be bent at different angles to the axis of the tube 24 to vary the shape of the water droplet to a desired configuration. The tube 24 also forms a resevoir for a portion of the water that makes up the water droplet 18.

Release of the water droplet 18 from the end of the tube 24 is controlled by means of the needle-like pintle 30 which extends into the opening 29 in the tubular member 28. The member 28 is formed from a resilient material such as rubber to provide a seal with the pintle 30 around the entrance to the opening 29. If the tube 24 is extended into the manifold, the pintle 30 forms the seal directly with the end of tube 24.

Means are provided for moving the pintle 30 relative to the tubular member 28. Such means is in the form of a solenoid 27 having a coil 36 and an armature 33. The pintle 30 is attached to the armature 33 by means of a resilient band 25. The coil 36 is mounted on a guide tube 34 which extends through an opening 31 in the support block or base 32. Means can be provided on the armature 33 to increase the weight of the pintle. Such means is in the form of one or more washers 39. A rubber bumper 38 is provided to deter noise when the valve is running.

The pintle 30 will normally rest on the flexible member 28 when the coil 36 is de-energized. On energization of the coil 36, the armature 33 will move upward into the coil 36 opening the passage 29 in the member 28.

The length of time that the passage is open will determine the size of the water droplet as described hereinafter. The valve is normally opened approximately one-tenth of a second and the time can be varied to increase or decrease the size of the water droplet.

Means can be provided for absorbing the momentum of the armature 33 and for adjusting the height of the pintle on movement away from the resilient member 28. Such means is in the form of a core 35 which is positioned in the upper end of the tube 34. The length of core 35 which extends into the tube 34 is set by means of a resilient ring 37 mounted on the outer surface of the core 35. The ring 37 rests on the top of the tube 34 to preset the length of the core 35 that enters the tube 34. The position of the core 35 in the tube 34 will limit the travel of the armature 33 and thus the size of the next water droplet. The rubber bumper 38 is adjusted to cooperate with the position of the core 35.

Figure 4:
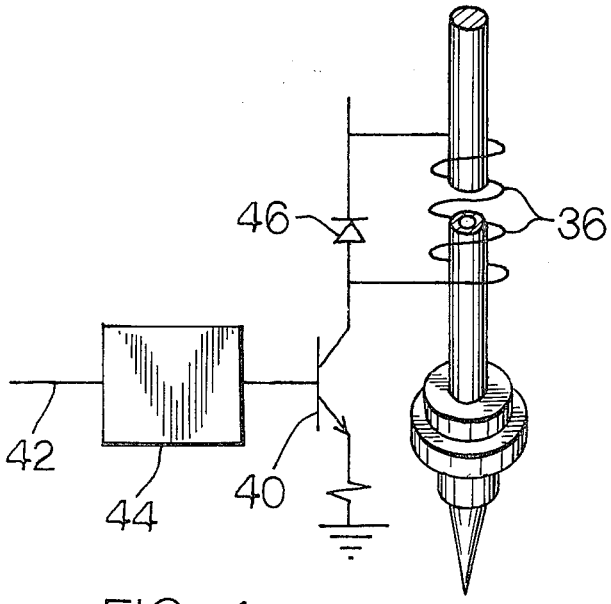
FIG. 4 is a circuit diagram of the control circuit for one of the water droplet valve assemblies.

Referring to FIG. 4, a circuit for controlling the position of the pintle 30 with respect to member 28 is shown. This circuit includes a power transistor 40 which is controlled by a monostable or one shot multivibrator 44 through a trigger circuit 42. The power transistor 40 is connected to the coil 36 with a field collapse diode 46 connected across the coil 36. The multi-vibrator is in the form of a conventional 555 timer such as National Semi-Conductor 506 DM/74123.

Figure 5:
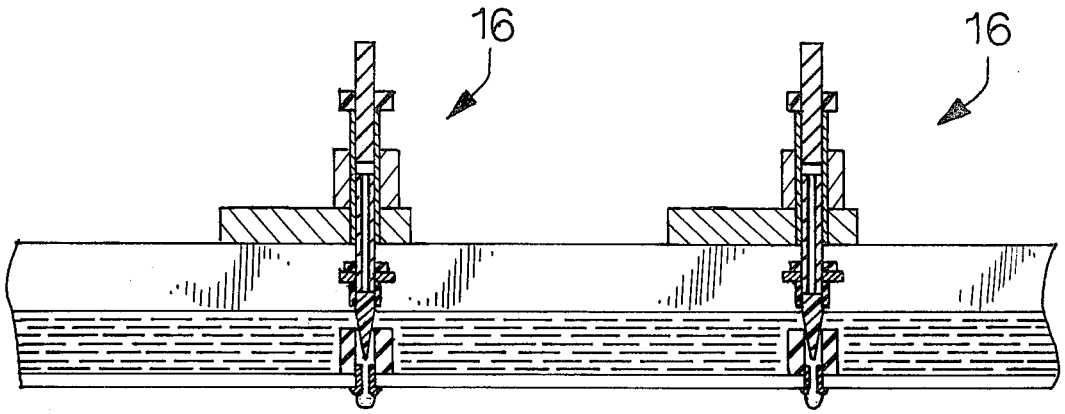
FIG. 5 is a section view of one of the manifold pipes showing two of the water droplet valve assemblies.

Referring to FIGS. 5 and 6, two of the valve assemblies 16 are shown in a spaced relation on a manifold pipe 20. The valve assemblies are arranged such that equal water pressure will be provided to each of the valve assemblies at all times as seen in the drawings. Means are provided for maintaining the water level at a predetermined level in the manifold pipe 20 so that the head at each of the members 28 is substantially equal thus, providing a more uniform size gravity fee of water droplet on actuation of the valve assemblies. In the configuration of the manifold shown in FIG. 1 there are 64 valve assemblies shown in a horizontal plane. However, additional valve assemblies can be added to increase and/or decrease the array if desired.

A programmed sequential release of water droplets 18 from the manifold is accomplished by the use of a computer which is connected to the trigger circuit 42 as is generally understood in the art. The computer includes a parallel interface to provide a digital machine language word which is interpreted by a decoder. The decoder selects the proper timers 44 in the array of valve assemblies. The timer 44 then opens the power transistor 40 to energize the coil 36 to open the valve assembly 16. The timers are preset to a controlled time period to close the valve when the proper amount of water has been provided to release the water droplet and concurrently load another hanging droplet ready to fall.

The computer can be any conventional computer which will provide 6 memory registers for certain calculated data. This data can be in the form of index, row, column, interval between droplets, interupt and strobe information. Programs can be preprogrammed or various source information can be used to activate the computer to produce the desired image. Source information may be based on the galvanic skin resistance or position of the viewer in respect to the fountain. The computer can also be used to generate electronic sound or control a tape trigging mechanism to play music. As an example the computer can sense the sunrise to turn lights off and darkness to turn lights on; preprogrammed computer color light laser display; and wind speed alter program or shutdown. The programs could be the solid memory punch tape or any of the various program sources which are available. It is also possible to program the manifold to play percussive rhythmic music with the falling water droplets acting as individual sound generation elements falling on water or on the solid base.

In this regard, water which accumulates in the base 14 can be recycled from a reservoir 50, provided below the base, back through lines 52 to the manifold. Any appropriate pump can be used to return the water to the manifold, an overflow line 55 and a drain 56 can be provided on the manifold. If desired the overflow line can be used to determine the level of the water in the manifold or a water level indicator can be provided to cut off water to the manifold when the manifold is filled to the proper level. Signals as transmitted from the switching transistors to the valve assemblied through electrical control trunk line 58.

A falling or rolling image can be viewed by means of continuous incandescent, fluorescent, mercury vapor carbon arc or Laser lights. If it is desired to show a continuous falling image moving either up or down it can be viewed by selecting a clock speed on a strobing source which creates this effect. Strobed, pulsed Laser, conventional light and chopping wheel run by a DC servo or phasing motor can also be used to produce this effect. Control of the lights can be integrated with the computer data in the form of strobe information as indicated above to correlate the operational lights in timed sequence to the position of the various images formed by the water droplets as they fall from the manifold. In this regard, stationary animated images can be created by means of a triggered strobing source which will hold the image stationary without any roll the stationary image can be animated by a programmed strobe controlled by the computer.

RESUME

The water fountain according to the present invention provides precise water drop control to produce various images. The ability to use computer control of the fall of the water droplets makes it possible to produce water droplets at intervals of 1/10,000 of a second. Combining an array of valve assemblies as disclosed herein with speed control enhances image resolution. Although each valve assembly requires up to 1/10 of second to form a water drop, proper selection of valve assemblies will produce the desired image. The valve assemblies then make it possible to utilize the speed of the computer programming in producing a visual well defined image.

The embodiment of the invention in which an exclusive property or privilege is claimed are defined as follows:

1. A free falling water droplet fountain comprising a manifold having a series of openings, means for independently controlling the size and rate of release of water droplets from said openings, said controlling means including a plurality of valve assemblies for defining the form and size of said water droplets, said controlling means including timing means connected to said valve assemblies to selectively control the length of time of opening to form the water droplets and the time of initiation of each of the valve assemblies to release the droplets at programmed intervals whereby a constant or asymmetrical frequency can be provided for the initialization of release of water droplets from the openings and a constant or asymmetrical size of water droplet can be provided within said frequency.

2. The fountain according to claim 1, wherein said valve assemblies each include a needle-like valve pintle and a resilient tubular member forming a reservoir for the water and having a central opening to define a valve seat for said pintle, said pintle being movable between open and closed positions relative to said valve seat to control the release of water droplets from said reservoir.

3. The fountain according to claim 2 wherein said valve assemblies include a tubular member positioned in each of said openings and a flange at the lower end of said member, said flange being set to a predetermined angular relation to said tubular member to define the formation of said water droplets.

4. The assembly according to claim 1 including a base located in a vertically spaced relation to the manifold to provide a three dimensional viewing space for said water droplets.

5. The fountain according to claim 1, including means for selectively illuminating said water droplets to provide a falling, rising or rolling image.

6. The fountain according to claim 1 including computer means for controlling said valve assemblies.

7. The fountain according to claim 1 wherein means are provided for maintaining a predetermined level of water in said manifold whereby equal water pressure is provided at the valve assemblies.

8. A program controllable fountain for providing a variety of three dimensional water droplet images, said fountain comprises a water manifold, valve means in said manifold for releasing water droplets from said manifold, and timing means connected to said valve means for independently controlling the rate of release of water droplets from each of said valve means and independently controlling the size of the water droplets at different time intervals and duration in response to signals from the program whereby a variety of three dimensional images can be formed.

9. The fountain according to claim 8 including a light source responsive to the program signals to illuminate the images formed by the water droplets.

10. The fountain according to claim 8 or 9 including a base beneath said manifold to recycle the water.

11. The fountain according to claim 8 wherein said valve means includes a water droplet forming member.

12. The fountain according to claim 1, wherein said valve means includes a tapered pintle and a tubular member, said tapered pintle being engagable with said tubular member to form a seal and including a rubber bumper on said pintle to eliminate noise.

13. The fountain according to claim 8 wherein said manifold includes means for maintaining an equal water pressure at each valve means.

* * * * *